US011049457B1

(12) United States Patent
Ono et al.

(10) Patent No.: US 11,049,457 B1
(45) Date of Patent: Jun. 29, 2021

(54) MIRRORED PIXEL ARRANGEMENT TO MITIGATE COLUMN CROSSTALK

(71) Applicant: Apple Inc., Cupertino, CA (US)

(72) Inventors: Shinya Ono, Cupertino, CA (US); Chin-Wei Lin, San Jose, CA (US); Chen-Ming Chen, Taoyuan (TW); Chun-Chieh Lin, Taoyuan (TW); Gihoon Choo, Santa Clara, CA (US); Hassan Edrees, Cupertino, CA (US); Zino Lee, Gyeonggi-do (KR)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/852,234

(22) Filed: Apr. 17, 2020

Related U.S. Application Data

(60) Provisional application No. 62/862,919, filed on Jun. 18, 2019.

(51) Int. Cl.
*G09G 3/3266* (2016.01)

(52) U.S. Cl.
CPC ... *G09G 3/3266* (2013.01); *G09G 2320/0209* (2013.01); *G09G 2320/0233* (2013.01)

(58) Field of Classification Search
CPC ..... G09G 3/3266; G09G 2320/0209; G09G 2320/0233
See application file for complete search history.

(56) References Cited

U.S. PATENT DOCUMENTS

| | | | | |
|---|---|---|---|---|
| 8,287,386 | B2 | 10/2012 | Miller et al. | |
| 8,519,915 | B2 * | 8/2013 | Asano | H01L 27/124 345/76 |
| 8,599,121 | B2 | 12/2013 | Yamada | |
| 9,361,821 | B2 | 6/2016 | Tani et al. | |
| 10,037,738 | B2 | 7/2018 | Kitsomboonloha et al. | |
| 10,134,335 | B2 | 11/2018 | Chaji et al. | |
| 10,608,072 | B2 | 3/2020 | Song et al. | |
| 2001/0017372 | A1 * | 8/2001 | Koyama | G09G 3/3648 257/72 |
| 2003/0205968 | A1 * | 11/2003 | Chae | H01L 27/3251 313/500 |
| 2006/0017393 | A1 * | 1/2006 | Kang | G09G 3/32 315/169.3 |
| 2008/0024529 | A1 * | 1/2008 | Asano | G09G 3/3233 345/697 |
| 2009/0015578 | A1 | 1/2009 | Fish et al. | |

(Continued)

*Primary Examiner* — Rodney Amadiz
(74) *Attorney, Agent, or Firm* — Treyz Law Group, P.C.; Jason Tsai

(57) ABSTRACT

A display may include an array of pixels, where each pixel in the array includes an organic light-emitting diode coupled to a drive transistor and other associated thin-film transistors. The array may be grouped into column pairs, where each column pair includes a first pixel column and a second pixel column that is mirrored with respect to the first pixel column. The drive transistors within each column pair may be formed towards the center of that column pair, whereas the data lines associated with that column pair may be formed along the outer peripheral edges of that column pair. Configured in this way, parasitic coupling between the data lines and any sensitive/floating nodes of the drive transistor may be substantially reduced, which mitigates pixel column crosstalk and ensures luminance uniformity across the display.

20 Claims, 11 Drawing Sheets

(56) References Cited

U.S. PATENT DOCUMENTS

| | | | | |
|---|---|---|---|---|
| 2010/0231615 | A1* | 9/2010 | Tokuda | G09G 3/3241 345/690 |
| 2012/0105412 | A1* | 5/2012 | Kang | G09G 3/3233 345/211 |
| 2015/0009105 | A1* | 1/2015 | Nomura | G09G 3/3266 345/76 |
| 2019/0088208 | A1 | 3/2019 | Chang et al. | |
| 2019/0228726 | A1 | 7/2019 | Ono et al. | |

* cited by examiner

MIRRORED PIXEL ARRANGEMENT TO MITIGATE COLUMN CROSSTALK

This application claims the benefit of provisional patent application No. 62/862,919, filed Jun. 18, 2019, which is hereby incorporated by reference herein in its entirety.

BACKGROUND

This relates generally to electronic devices with displays and, more particularly, to display driver circuitry for displays such as organic light-emitting diode (OLED) displays.

Electronic devices often include displays. For example, cellular telephones and portable computers typically include displays for presenting image content to users. OLED displays have an array of display pixels based on light-emitting diodes. In this type of display, each display pixel includes a light-emitting diode and associated thin-film transistors for controlling application of data signals to the light-emitting diode to produce light.

In particular, each display pixel typically includes an organic light-emitting diode connected in series with a drive transistor. Each display pixel further includes a data loading transistor for loading a data value into that pixel. In practice, however, data toggling from one pixel column may be inadvertently coupled to an adjacent pixel column, which can cause the one or more voltages at the drive transistor to be perturbed. This type of undesired parasitic coupling is sometimes referred to as pixel column crosstalk, which can result in luminance non-uniformity across the display.

It is within this context that the embodiments herein arise.

SUMMARY

An electronic device may include a display having an array of display pixels. The display pixels may be organic light-emitting diode display pixels. The display may include a first pixel column having at least a first display pixel with a first organic-light emitting diode coupled in series with a first drive transistor, and a first data line coupled to the first display pixel. The display may further include a second pixel column having at least a second display pixel with a second organic-light emitting diode coupled in series with a second drive transistor, and a second data line coupled to the second display pixel. The first and second drive transistors may be physically interposed between the first and second data lines to reduce column pixel crosstalk. The first display pixel may be mirrored with respect to the second display pixel. Each pixel in the first pixel column may all have a first orientation. Each pixel in the second pixel column may all have a second orientation that is different than the first orientation.

The first drive transistor may have a drain terminal coupled to a routing line, where the routing line and the first data line are formed in the same metal routing layer of the display so that no shielding layer can be formed between the first drive transistor and the first data line. In another suitable arrangement, the routing line and the first data line may be formed in adjacent metal routing layers in the display so that no shielding layer can be formed between the first drive transistor and the first data line.

The first pixel column may be configured to support in-pixel threshold voltage compensation, where data is loaded into the first pixel column during a threshold voltage sampling and data programming phase. In particular, the first drive transistor may be electrically floating for a predetermined period of time after the threshold voltage sampling and data programming phase. The mirroring of the second pixel column with respect to the first pixel column also helps to prevent the first drive transistor from being inadvertently perturbed by data signals toggling in the second pixel column during the predetermined period of time.

DETAILED DESCRIPTION

Figure 1:
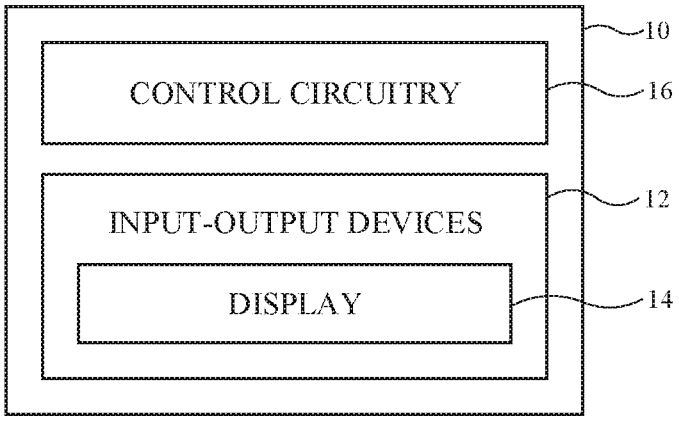
FIG. 1 is a diagram of an illustrative electronic device having a display in accordance with an embodiment.

An illustrative electronic device of the type that may be provided with a display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14 using an array of pixels in display 14. Device 10 may be a tablet computer, laptop computer, a desktop computer, a display, a cellular telephone, a media player, a wristwatch device or other wearable electronic equipment, or other suitable electronic device.

Display 14 may be an organic light-emitting diode display or may be a display based on other types of display technology. Configurations in which display 14 is an organic light-emitting diode (OLED) display are sometimes described herein as an example. This is, however, merely illustrative. Any suitable type of display may be used in device 10, if desired.

Display 14 may have a rectangular shape (i.e., display 14 may have a rectangular footprint and a rectangular peripheral edge that runs around the rectangular footprint) or may have other suitable shapes. Display 14 may be planar or may have a curved profile.

Figure 2:
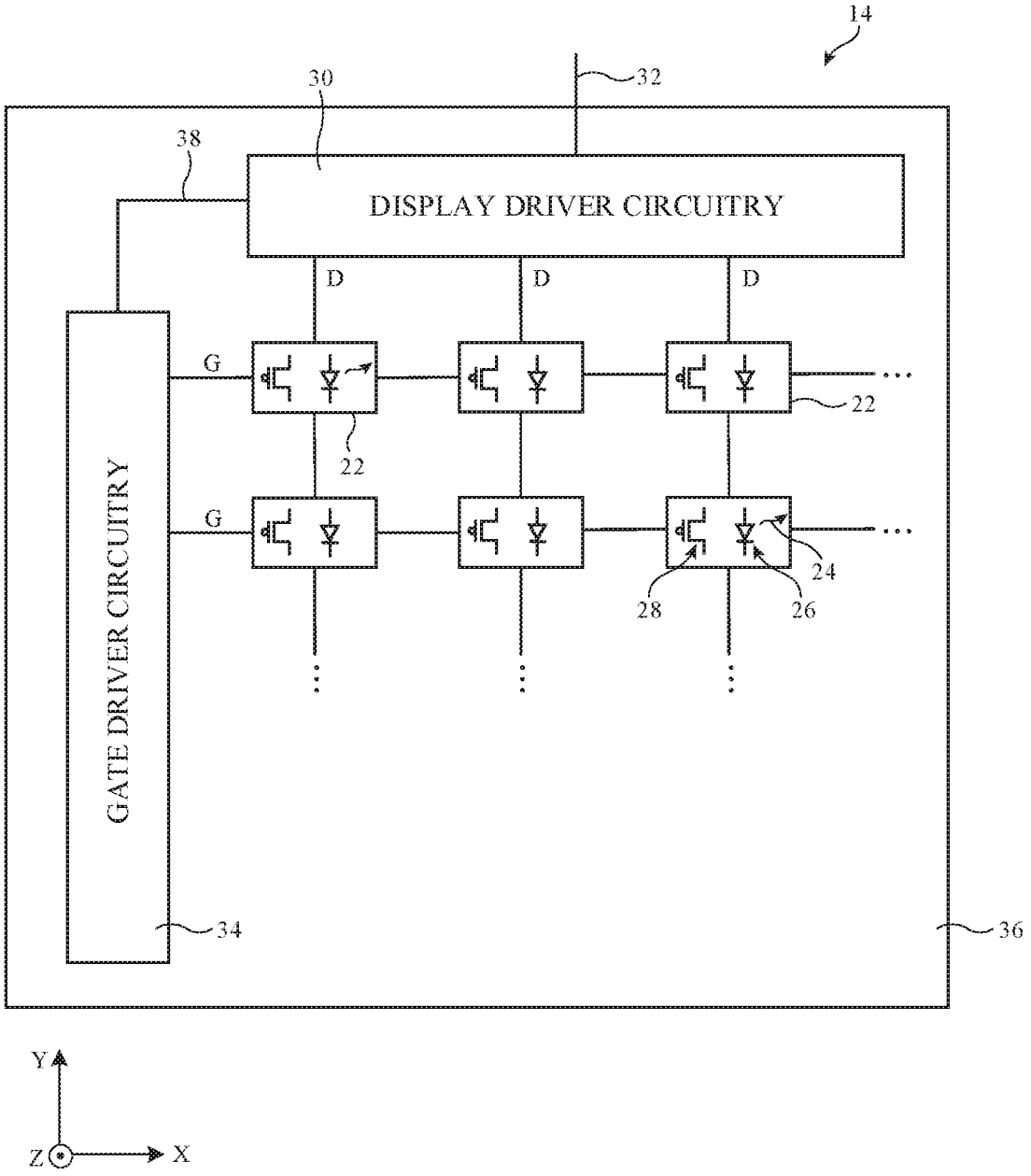
FIG. 2 is a diagram of an illustrative display having an array of organic light-emitting diode display pixels in accordance with an embodiment.

A top view of a portion of display 14 is shown in FIG. 2. As shown in FIG. 2, display 14 may have an array of pixels 22 formed on a substrate 36. Substrate 36 may be formed from glass, metal, plastic, ceramic, porcelain, or other substrate materials. Pixels 22 may receive data signals over signal paths such as data lines D and may receive one or more control signals over control signal paths such as horizontal control lines G (sometimes referred to as gate lines, scan lines, emission lines, etc.). There may be any suitable number of rows and columns of pixels 22 in display 14 (e.g., tens or more, hundreds or more, or thousands or more).

Each pixel 22 may have a light-emitting diode 26 that emits light 24 under the control of a pixel control circuit formed from thin-film transistor circuitry such as thin-film transistors 28 and thin-film capacitors). Thin-film transistors 28 may be polysilicon thin-film transistors, semiconducting-oxide thin-film transistors such as indium zinc gallium oxide transistors, or thin-film transistors formed from other semiconductors. Pixels 22 may contain light-emitting diodes of different colors (e.g., red, green, and blue) to provide display 14 with the ability to display color images.

Display driver circuitry 30 may be used to control the operation of pixels 22. The display driver circuitry 30 may be formed from integrated circuits, thin-film transistor circuits, or other suitable electronic circuitry. Display driver circuitry 30 of FIG. 2 may contain communications circuitry for communicating with system control circuitry such as control circuitry 16 of FIG. 1 over path 32. Path 32 may be formed from traces on a flexible printed circuit or other cable. During operation, the control circuitry (e.g., control circuitry 16 of FIG. 1) may supply circuitry 30 with information on images to be displayed on display 14.

To display the images on display pixels 22, display driver circuitry 30 may supply image data to data lines D (e.g., data lines that run down the columns of pixels 22) while issuing clock signals and other control signals to supporting display driver circuitry such as gate driver circuitry 34 over path 38. If desired, display driver circuitry 30 may also supply clock signals and other control signals to gate driver circuitry 34 on an opposing edge of display 14 (e.g., the gate driver circuitry may be formed on more than one side of the display pixel array).

Gate driver circuitry 34 (sometimes referred to as horizontal line control circuitry or row driver circuitry) may be implemented as part of an integrated circuit and/or may be implemented using thin-film transistor circuitry. Horizontal/row control lines G in display 14 may carry gate line signals (scan line control signals), emission enable control signals, and/or other horizontal control signals for controlling the pixels of each row. There may be any suitable number of horizontal control signals per row of pixels 22 (e.g., one or more row control lines, two or more row control lines, three or more row control lines, four or more row control lines, five or more row control lines, etc.).

Figure 3:
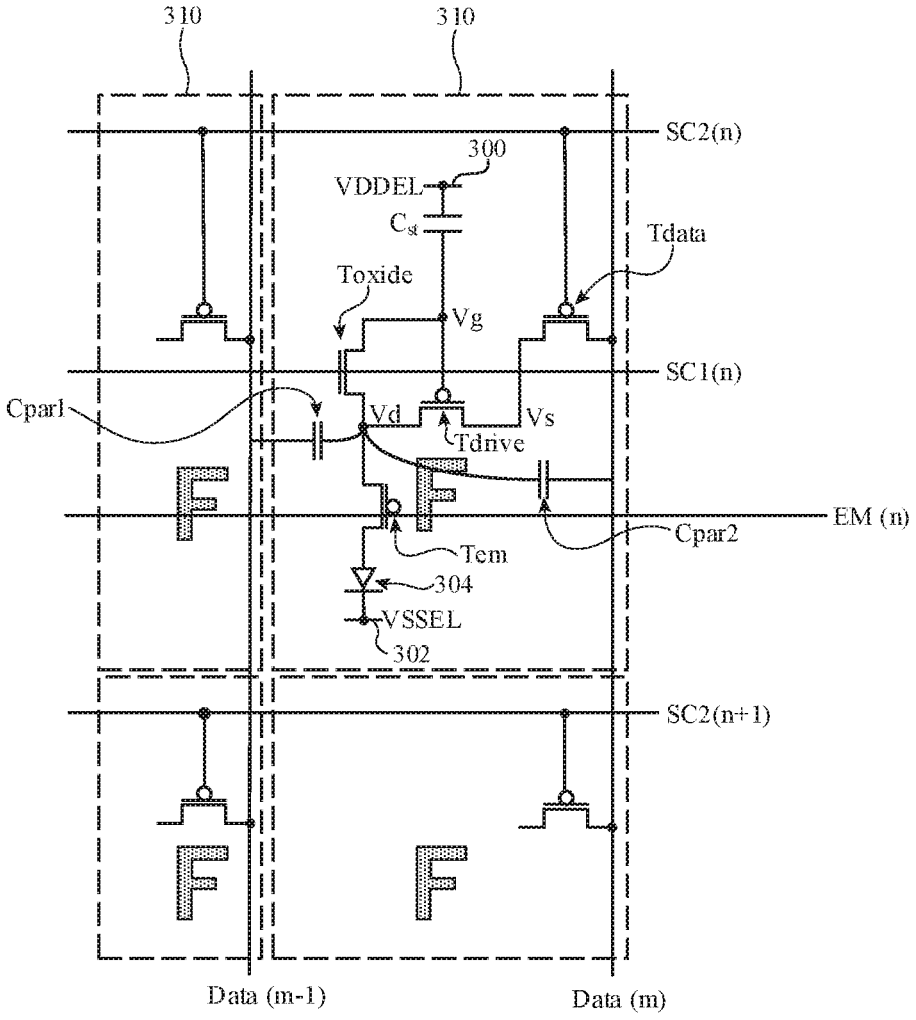
FIG. 3 is a circuit diagram of a display pixel configuration that is susceptible to column crosstalk.

FIG. 3 is a circuit diagram of an array of display pixels 310. As shown in FIG. 3, each display pixel 310 may include at least a storage capacitor Cst, an n-type (i.e., n-channel) transistor such as semiconducting-oxide transistor Toxide, and p-type (i.e., p-channel) transistors such as a drive transistor Tdrive, a data loading transistor Tdata, and an emission transistor Tem. While transistor Toxide is formed using semiconducting oxide (e.g., a transistor with a channel formed from semiconducting oxide such as indium gallium zinc oxide or IGZO), the other p-channel transistors may be thin-film transistors formed from a semiconductor such as silicon (e.g., polysilicon channel deposited using a low temperature process, sometimes referred to as LTPS or low-temperature polysilicon). Semiconducting-oxide transistors exhibit relatively lower leakage than silicon transistors, so implementing transistor Toxide as a semiconducting-oxide transistor will help reduce flicker (e.g., by preventing current from leaking away from the gate terminal of drive transistor Tdrive).

In another suitable arrangement, transistors Toxide and Tdrive may be implemented as semiconducting-oxide transistors while any remaining transistors within pixel 310 are LTPS transistors. If desired, any of the remaining transistors Tdata, Tem, and others may be implemented as semiconducting-oxide transistors. Moreover, any one or more of the p-channel transistors may be n-type (i.e., n-channel) thin-film transistors.

Display pixel 310 may further include an organic light-emitting diode (OLED) 304. A positive power supply voltage VDDEL may be supplied to positive power supply terminal 300, and a ground power supply voltage VSSEL may be supplied to ground power supply terminal 302. Positive power supply voltage VDDEL may be 3 V, 4 V, 5 V, 6 V, 7 V, 2 to 8 V, or any suitable positive power supply voltage level. Ground power supply voltage VSSEL may be 0 V, −1 V, −2 V, −3 V, −4 V, −5 V, −6V, −7 V, or any suitable ground or negative power supply voltage level. The state of drive transistor Tdrive controls the amount of current flowing from terminal 300 to terminal 302 through diode 304, and therefore the amount of emitted light from display pixel 310.

In the example of FIG. 3, storage capacitor Cst may be coupled between power supply terminal 300 and the gate terminal of p-type transistor Tdrive. Transistor Toxide may have a first source-drain terminal connected to the gate terminal of transistor Tdrive, a second source-drain terminal connected to the drain terminal of transistor Tdrive, and a gate terminal configured to receive a first scan control signal SC1(*n*). The "n" signifies the reference to row n. Emission transistor Tem may be coupled in series between transistor Tdrive and light-emitting diode 304 and may have a gate terminal configured to receive an emission control signal EM(n). Data loading transistor Tdata may have a first source-drain terminal connected to the source terminal of transistor Tdrive, a second source-drain terminal connected to the data line, and a gate terminal configured to receive a second scan control signal SC2(*n*). Scan control signals SC1 and SC2 may be provided over row control lines (see lines G in FIG. 2). Although pixel 310 is shown to include only four thin-film transistors, pixel 310 may generally include any suitable number of transistors (e.g., pixel 310 may include additional emission transistors, initialization transistors, etc.) and capacitors (e.g., pixel 310 may include at least two capacitors or more than two capacitors).

Pixel 310 of the type shown in FIG. 3 may be subject to process, voltage, and temperature (PVT) variations. Due to such variations, transistor threshold voltages between different display pixels may vary. Most importantly, variations in the threshold voltage of transistor Tdrive can cause different display pixels to produce amounts of light that do not match the desired image. In an effort to mitigate threshold voltage variations, display pixel 310 of the type shown in FIG. 3 may be operable to support in-pixel threshold voltage (Vth) compensation. In-pixel threshold voltage (Vth) compensation operations, sometimes referred to as an in-pixel Vth canceling scheme, may generally include at least an initialization phase, a threshold voltage sampling phase, a data programming phase, and an emission phase. During the threshold voltage sampling phase, the threshold voltage of transistor Tdrive may be sampled using storage capacitor Cst. Subsequently, during the emission phase, emission current flowing through transistor Tem into the light-emitting diode 304 may have a term that cancels out with the sampled Vth. As a result, the emission current will be independent of the drive transistor Vth and therefore be immune to any Vth variations at the drive transistor.

Another technical issue that may arise in the pixel arrangement of FIG. 3 is data signal crosstalk from an adjacent pixel column. Still referring to the configuration of FIG. 3, each display pixel 310 exhibits the same orientation, as indicated by the notation "F". In other words, each pixel 310 in a particular pixel column may be connected to a corresponding data line positioned to the right of that pixel. For instance, each pixel 310 located along the left column in FIG. 3 is connected to a first data line Data(m−1), whereas each pixel 310 located along the right column is connected to a second data line Data(m). The "m" signifies the reference to column m, whereas "m−1" signifies the reference to the preceding column in the array.

Oriented in this way, one can see that the drain terminal of transistor Tdrive within pixel 310 in (row n, column m) is coupled to the first data line of a preceding column via a first parasitic capacitance Cpar1 and is further coupled to its own second data line via a second parasitic capacitance Cpar2. Assuming the first data line is physically closer to the drain terminal than the second data line, parasitic capacitance Cpar1 may be greater than parasitic capacitance Cpar2. If parasitic capacitance Cpar1 is too large, there is a risk that data toggling from the preceding column (m−1) can be horizontally coupled to pixel 310 in column m, which can perturb drain voltage Vd and would result in undesired pixel column crosstalk.

Figure 4A:
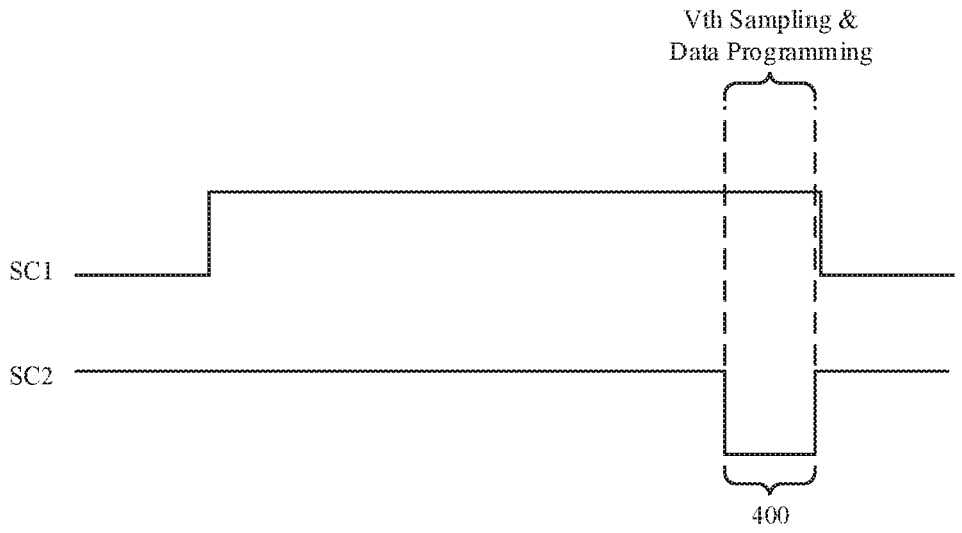
FIG. 4A is a timing diagram illustrating how scan control signals may be pulsed in accordance with an embodiment.
Figure 4B:
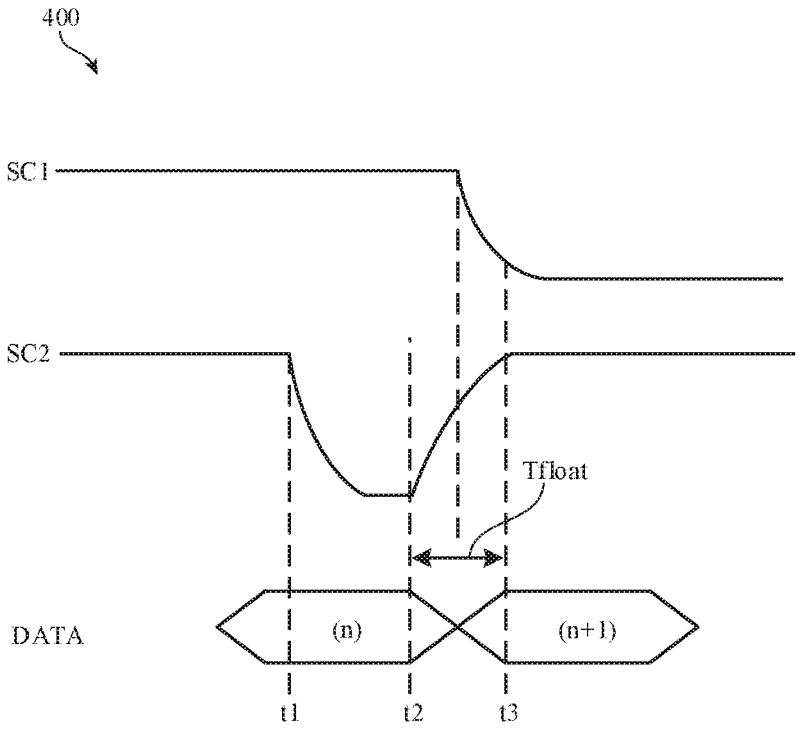
FIG. 4B is a timing diagram illustrating a data transition period in accordance with an embodiment.

Pixel column crosstalk can occur when the gate, drain, and source terminals of the drive transistor is floating during data transition events. FIGS. 4A and 4B are timing diagrams illustrating how scan control signals SC1 and SC2 in any given pixel row may be pulsed in accordance with an embodiment. As shown in FIG. 4A, first scan control signal SC1 may first be pulsed high (i.e., signal SC1 may be asserted). While signal SC1 is high, the second scan control signal SC2 may be pulsed low (e.g., to initiate the threshold voltage sampling and data programming phases of operation). Note that signal SC1 is controlling an n-channel transistor and is thus an active-high gate control signal (i.e., SC1 is asserted when it is driven high and deasserted when it is driven low), whereas signal SC2 is controlling a p-channel transistor and is thus an active-low gate control signal (i.e., SC2 is asserted when it is driven low and deasserted when it is driven high).

Aspects of the time period 400 in FIG. 4A near the pulse edges are illustrated in more detail in FIG. 4B. As shown in FIG. 4B, the second scan signal SC2 has a falling pulse edge at time t1 and a rising pulse edge at time t2. Subsequently, the first scan signal SC1 has a falling pulse edge at time t3. The period during which scan signal SC2 is asserted (e.g., driven low) from time t1 to t2 is when a data signal is loaded into that particular row (i.e., row "n"). After scan signal SC1 has be deasserted (e.g., driven low) at time t3, a new data signal for the next row "n+1" may be loaded in.

Operated in this way, there is a period of time between t2 and t3 where scan signal SC2 is at least partially driven high and where scan signal SC1 is at least partially driven low. When active-high signal SC1 is at least partially driven and when active-low signal SC2 is at least partially driven high, thin-film transistor Toxide (which is controlled by signal SC1) and transistor Tdata (which is controlled by signal SC2) will both be turned off. As a result, the voltage Vg at the gate terminal of transistor Tdrive, the voltage Vd at the drain terminal of transistor Tdrive, and the voltage Vs at the source terminal of transistor Tdrive are all electrically floating (i.e., not actively driven by any power supply source). Thus, drive transistor Tdrive may be especially susceptible to parasitic coupling during this time period Tfloat between the transitions of signals SC2 and SC1 since all of its gate/drain/source terminals are floating. Time period Tfloat also incidentally coincides with the data toggling (or data transition) period from one row to the next.

Figure 5:
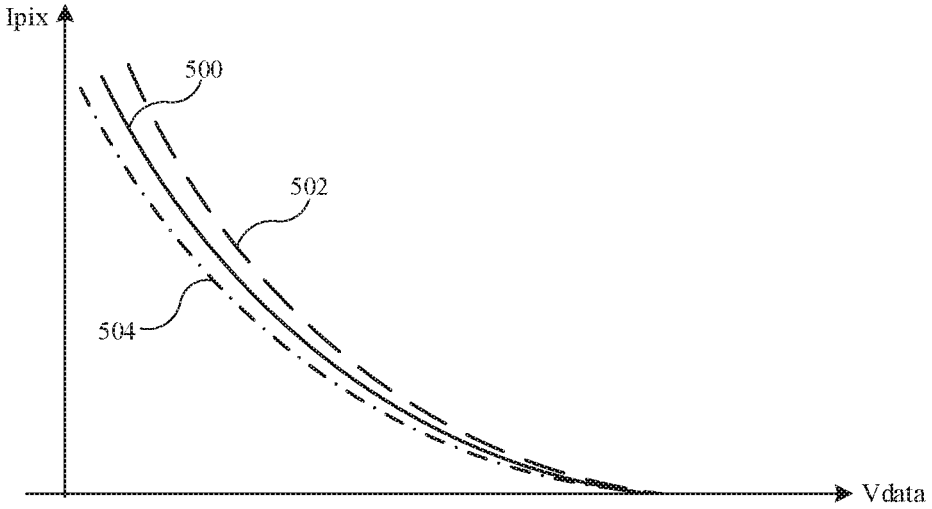
FIG. 5 is a diagram plotting pixel current as a function of a data programming value.

The pixel arrangement of FIG. 3 where the data line of each column is formed to the right of each pixel 310 may be especially susceptible to pixel column crosstalk during the floating period when all terminals of the drive transistor are electrically floating. FIG. 5 is a diagram plotting pixel emission current Ipix as a function of the data programming value Vdata. Curve 500 represents the current behavior of a given pixel in (row n, column m) when the data signal in the preceding column (m−1) does not change during the data toggling period. Curve 502 illustrates the current behavior of the given pixel in (row n, column m) when the data signal in the preceding column (m−1) decreases in value during the data transitioning period. Curve 504 represents the current behavior of the given pixel when the data signal in the preceding column increases in value during the data toggle/transition period. The deviations between curves 500, 502, and 504 are due to the undesired parasitic coupling of data crosstalk from the preceding column (e.g., due to data kick coupled via parasitic capacitance Cpar1 in FIG. 3). Pixel column crosstalk generated in this way can cause luminance non-uniformity across the display.

Figure 6:
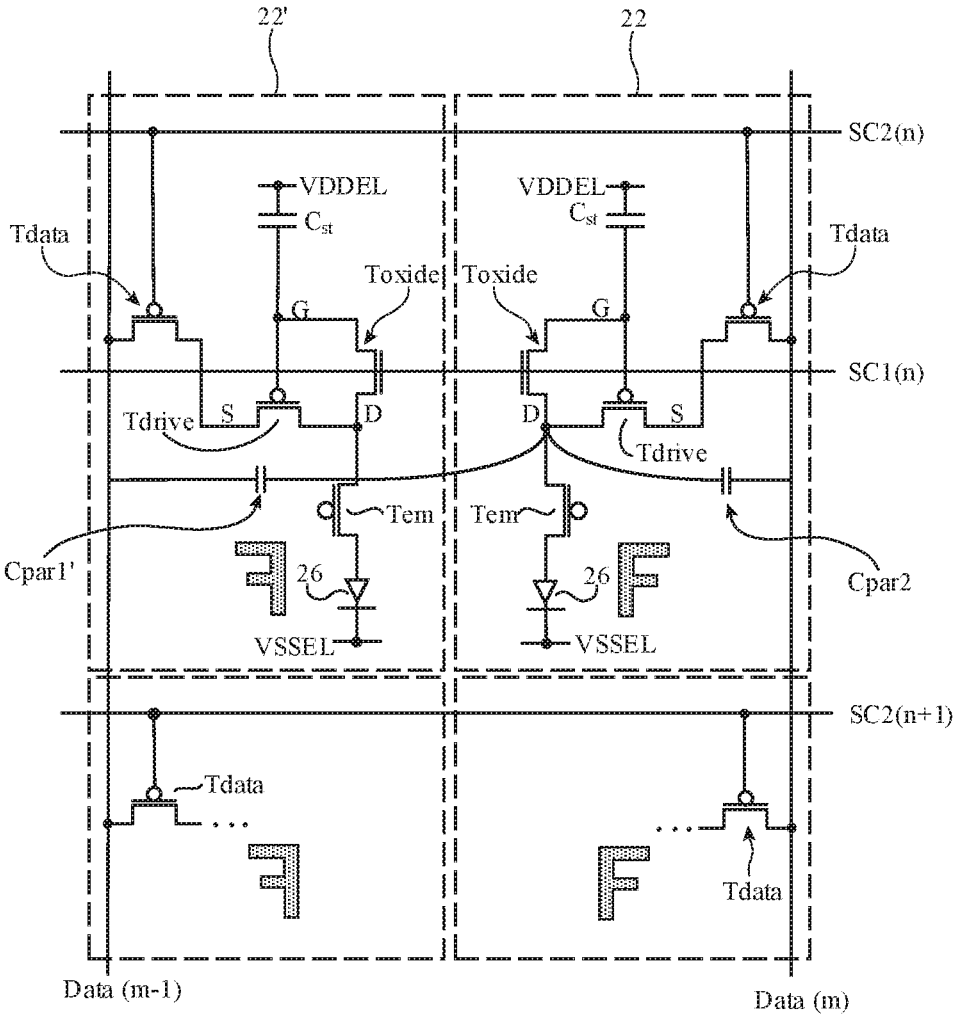
FIG. 6 is a circuit diagram of an illustrative mirrored pixel arrangement configured to mitigate column crosstalk in accordance with an embodiment.

In accordance with an embodiment, FIG. 6 shows an illustrative mirrored pixel arrangement configured to mitigate pixel column crosstalk. As shown in FIG. 6, each pixel 22 may include at least an organic light-emitting diode (OLED) 26, a drive transistor Tdrive coupled in series with diode 26, an emission control transistor Tem connected in series with transistor Tdrive and OLED 26, a semiconducting-oxide transistor Toxide coupled between the gate and drain terminals of the drive transistor, a data loading transistor Tdata coupled to the source terminal of the drive transistor, a charge storage capacitor Cst connected to the gate terminal of the drive transistor, and one or more additional pixel thin-film transistors (e.g., additional scan control transistors, emission control transistors, initialization transistors, reset transistors, etc.).

In contrast to the pixel arrangement of FIG. 3, FIG. 6 illustrates a mirrored pixel arrangement scheme where pixel 22 in the right column is oriented normally (as indicated by the notation "F") but where pixel 22' in the left column is mirrored with respect to pixel 22 to its right (as indicated by the notation backwards "F"). Every display pixel in the same column should be oriented in the same direction. Thus, every pixel 22 in the right column may be coupled to data line Data(m) formed on the right side of that column, whereas every pixel 22 in the left column may be coupled to data line Data(m−1) formed on the left side of that column. Configured in this way, the parasitic capacitance between the drain terminal of transistor Tdrive is represented as Cpar2, and the parasitic capacitance between the drain terminal of transistor Tdrive is represented as Cpar1'. Although Cpar2 may stay the same in both FIG. 3 and FIG. 6, Cpar1' in FIG. 6 will be much lower than Cpar1 in FIG. 3 since data line Data(m−1) from the preceding column is physically located much further away from transistor Tdrive in column m. As a result, the pixel column crosstalk will be substantially reduced during data toggling periods, which improves luminance uniformity across the display.

Figure 7:
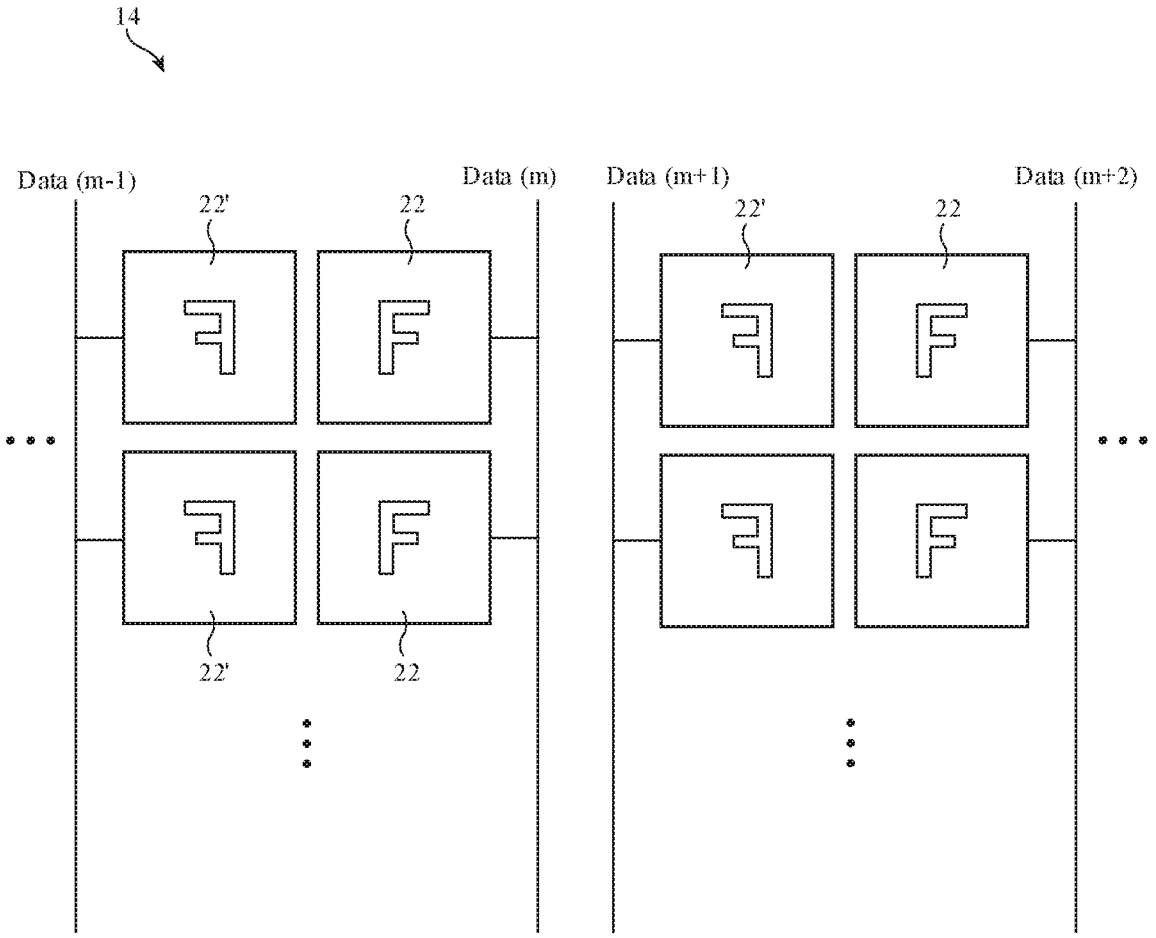
FIG. 7 is a diagram of an array of display pixels configured using the mirrored pixel arrangement of FIG. 6 in accordance with an embodiment.

FIG. 7 is a diagram of an array of display pixels configured using the mirrored pixel arrangement of FIG. 6 in accordance with an embodiment. As shown in FIG. 7, display pixels 22' in column (m−1) may be mirrored with respect to display pixels 22 in column m. In other words, the associated data lines will flank the two outer sides of that pixel column pair (e.g., data line Data(m−1) will be formed to the left of pixels 22' while data line Data(m) will be formed to the right of pixels 22). Similarly, display pixels 22' in column (m+1) may be mirrored with respect to display pixels 22 in column (m+2). The associated data lines surround the two outer edges of that pixel column pair (e.g., data line Data(m+1) will be formed to the left of pixels 22' while data line Data(m+2) will be formed to the right of pixels 22).

In the example of FIG. 7, data lines Data(m) is formed directly adjacent to data line Data(m+1); this does not pose an issue as long as Cpar2 (see, e.g., FIG. 6) is small. Parasitic capacitance Cpar2 would be acceptably small so long as pixel 22 is laid out in a way such that the gate/drain/source nodes of drive transistor Tdrive is not formed too close, immediately adjacent to, or directly overlapping with the corresponding data line.

Figure 8:
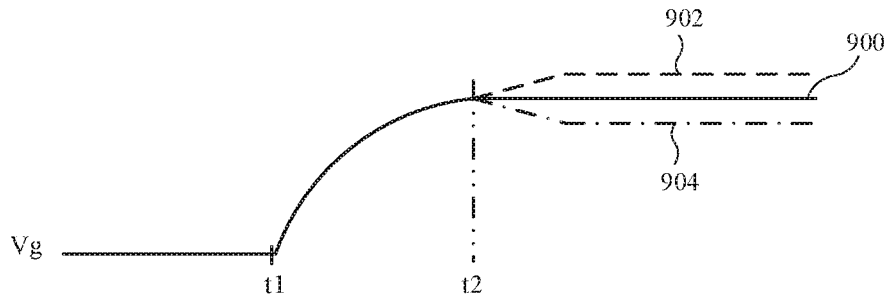
FIG. 8 is a timing diagram showing how the gate terminal voltage of a drive transistor may be perturbed due to column crosstalk.

FIG. 8 is a timing diagram showing how the gate terminal voltage (Vg) of a drive transistor within pixel 310 in FIG. 3 may be perturbed due to column crosstalk. In FIG. 8, waveform 900 represents the behavior of Vg when the data signal from an adjacent pixel column does not change during the data toggling period (i.e., period Tfloat in FIG. 4B), waveform 902 represents the behavior of Vg when the data signal from the adjacent pixel column increases during the data toggling period, and waveform 904 represents the behavior of Vg when the data signal from the adjacent pixel column decreases during the data transition period. Thus, the final value of gate terminal voltage Vg of the drive transistor may be dependent on whether or not the data value from an adjacent column changes during Tfloat. This dependence would lead to display non-uniformity and other undesired display artifacts.

Figure 9:
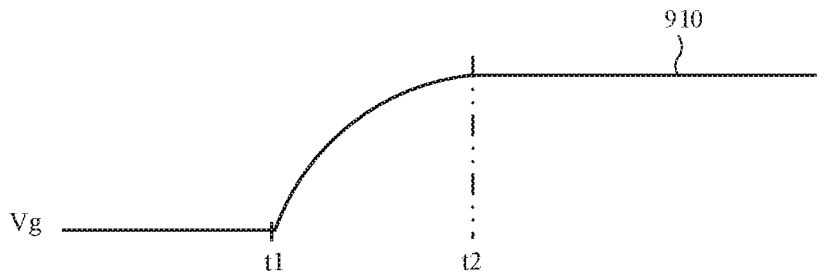
FIG. 9 is a timing diagram illustrating how the gate terminal voltage of a drive transistor remains unperturbed in accordance with an embodiment.

FIG. 9 is a timing diagram illustrating how the gate terminal voltage (Vg) of a drive transistor within pixel 22 in FIG. 6 may remain unperturbed during data toggling periods. As shown in FIG. 9, waveform 910 represents the behavior of Vg regardless whether the data signal from an adjacent pixel column stays the same, increases, or decreases. In other words, the final value of gate terminal voltage Vg of the drive transistor is independent of the data value from an adjacent column. This independence helps to provide display uniformity.

Figure 10:
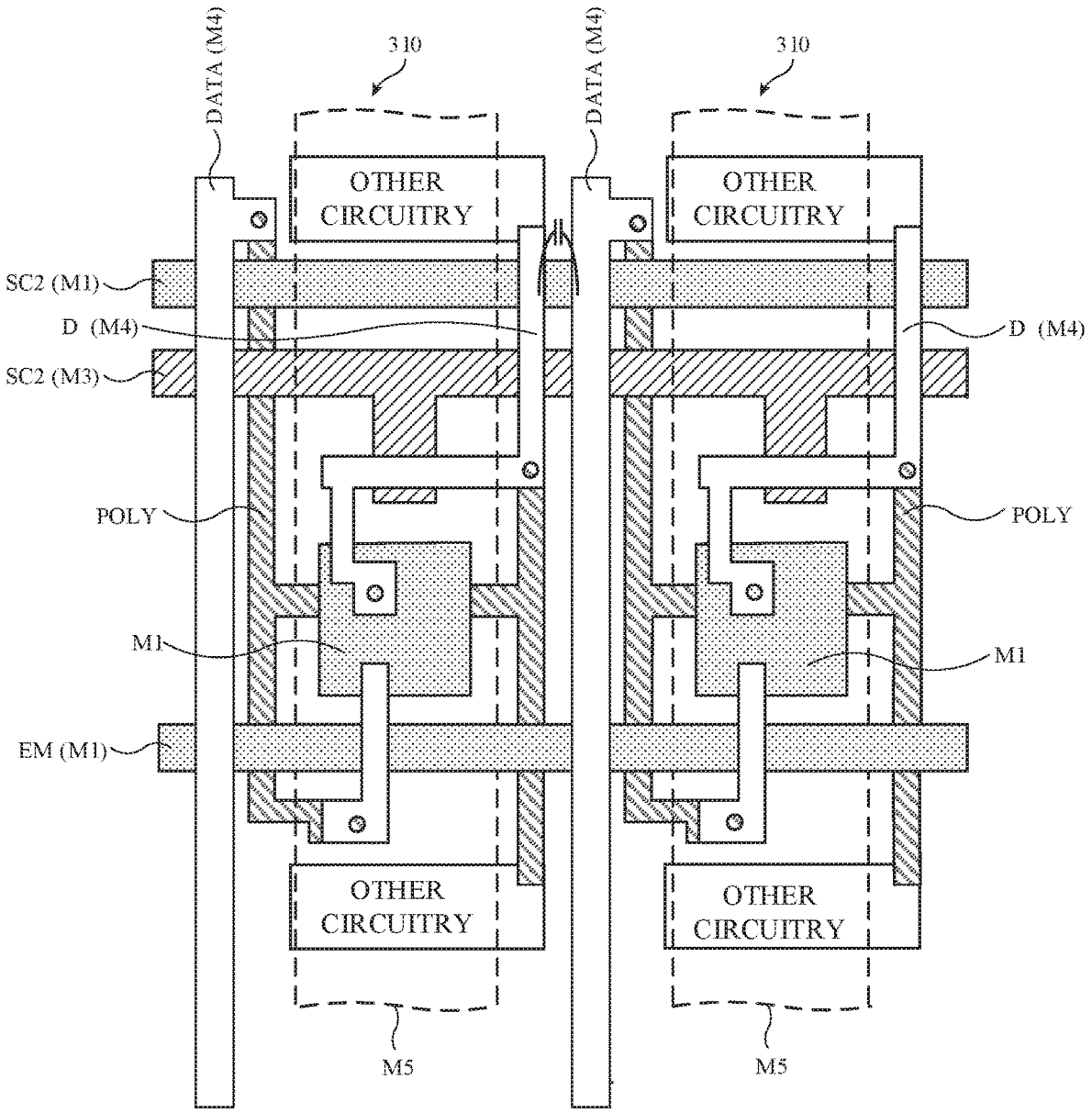
FIG. 10 is atop layout view of the display pixel architecture shown in FIG. 3.

FIG. 10 is a top layout view of the display pixel architecture shown in FIG. 3. As shown in FIG. 10, the drive transistor in the left pixel 310 has a drain (D) terminal that is formed immediately adjacent to the data line in the right pixel column. This results in a large parasitic capacitance, which is the root cause of column crosstalk.

Figure 11:
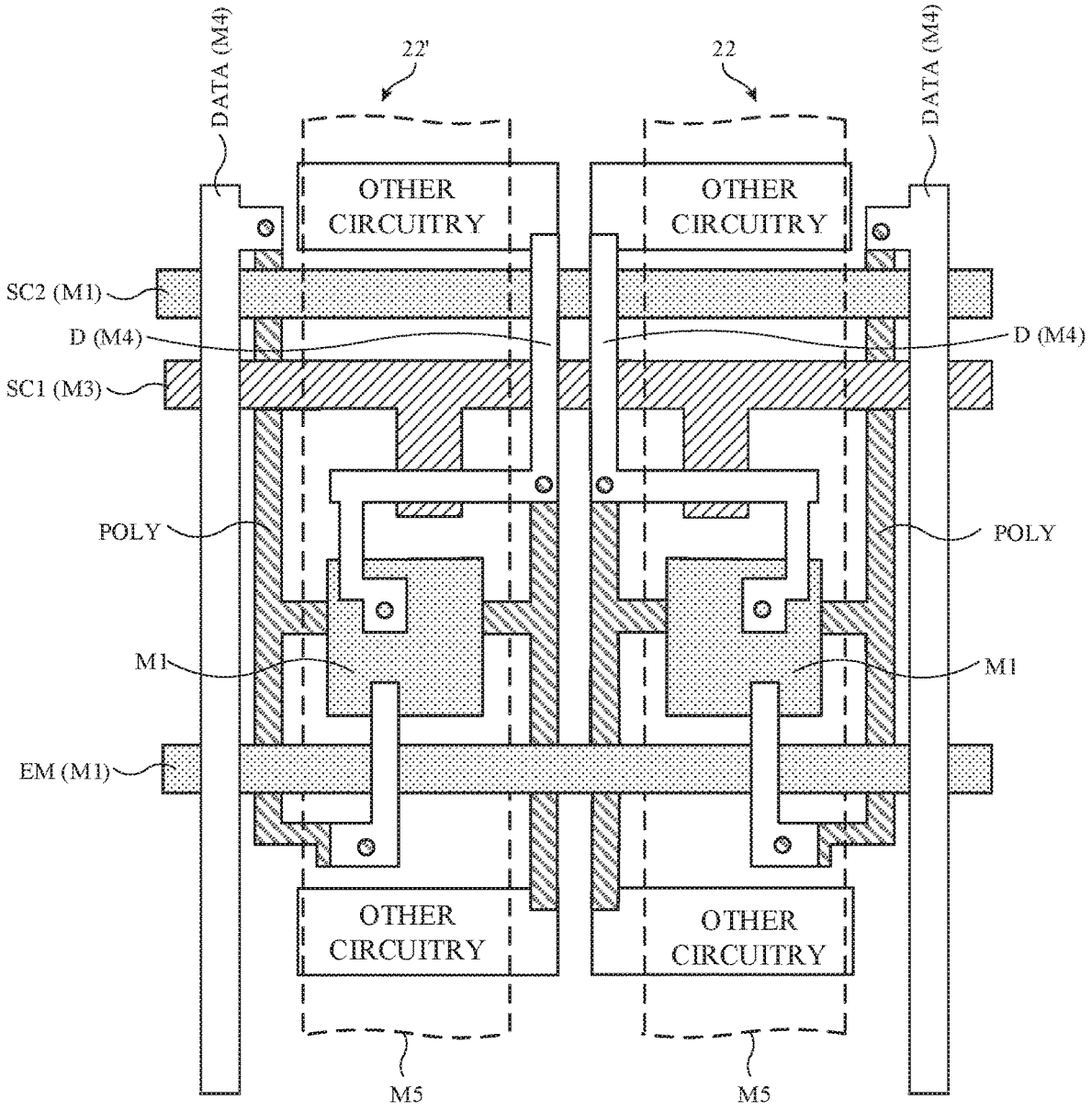
FIG. 11 is a top layout view of an illustrative display pixel architecture of the type shown in FIG. 6 in accordance with an embodiment.

FIG. 11 is a top layout view of an illustrative display pixel architecture of the type shown in FIG. 6 in accordance with an embodiment. As shown in FIG. 11, the drive transistor in the left pixel 22' has a drain (D) terminal that is not formed adjacent to any data line. In the example of FIG. 11, the drain terminals of the drive transistor of both columns are formed close to one another (due to the mirrored arrangement), and the data lines are formed on the opposing side of each pixel (e.g., the D node of the left pixel 22' is formed on the right side of that pixel while the data line of pixel 22' is formed on the left side of that pixel; the D node of the right pixel 22 is formed on the left side of that pixel while the data line of pixel 22 is formed on the right side of that pixel). In contrast to FIG. 1, note that the drive transistor of both pixels 22 and 22' are physically interposed between the data lines surrounding that pixel pair.

In the example of FIG. 11, both the data lines and the D node (i.e., the drain terminal of the drive transistor) are shown to be routed in the fourth metal routing layer M4. Since they are routed in the same metal routing, it would not be possible to insert a shielding layer between the two nodes to prevent parasitic coupling. This limitation would hold true even if the data lines and the D node are routing in adjacent metal routing layers (e.g., even if the data lines were routing in metal routing layer M5 or M3). However, if the data lines and the D node were to be routed in non-adjacent metal routing layers, it would be possible to insert one or more conductive shielding layers that prevent parasitic coupling between these two nodes. For example, if the data lines were routed in metal layer M5 and the D node were routed in metal layer M3, it would be advantageous to further insert a shielding layer in metal layer M4 to prevent any undesired coupling from the data lines in M5 to the drain node in M3.

The different routing layers of a display stack are shown in the legend of FIGS. 10 and 11. The polysilicon (POLY) layer is closest to the substrate, whereas metal routing layer M5 and above are furthest from the substrate. As shown by the legend, the first metal routing layer M1 of the display stack may serve as the gate layer of the silicon thin-film transistors, whereas the third metal routing layer M3 of the display stack may serve as the gate layer of the semiconducting-oxide transistors. Configured in this way, the semiconducting-oxide transistors may be formed above the silicon transistors. This is merely illustrative. If desired, the semiconducting-oxide transistors may optionally be formed below the silicon transistors or in the same layer as the silicon transistors.

Figure 12:
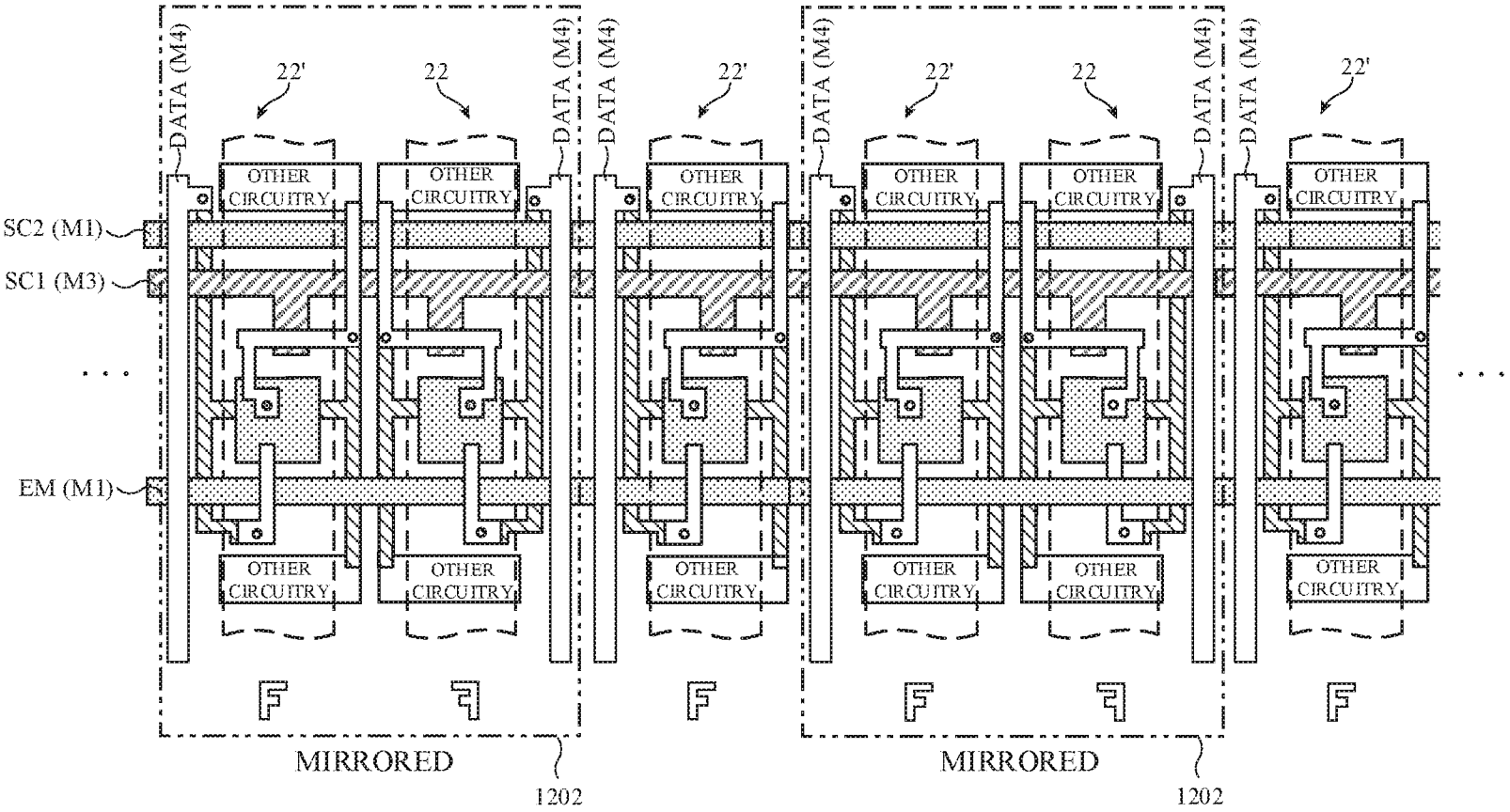
FIG. 12 is a diagram showing how only a subset of neighboring pixels are mirrored in accordance with an embodiment.

The arrangement of FIG. 7 in which each neighboring pair of display pixels are mirrored with respect to each other is merely illustrative. FIG. 12 is a diagram of another suitable arrangement in which only a subset of neighboring pixels are mirrored. As shown in FIG. 12, the two leftmost pixels in FIG. 12 are mirrored with respect to each other (see pixels in dotted box 1202). The third pixel 22' from the left, however, may be mirrored with respect to pixel 22 to its left but is not mirrored with respect to pixel 22' to its right. This pattern may be repeated for the remainder of the pixel row and for each row in the array. If desired, other regular or irregular patterns in which one or more pixels in a given row is not mirrored with respect to its neighbors may be implemented (e.g., one out of every two consecutive pixels may not be mirrored with respect to one of its neighbors, one out of every three consecutive pixels may not be mirrored with respect to one of its neighbors, one out of every four consecutive pixels may not be mirrored with respect to one of its neighbors, one out of every five consecutive pixels may not be mirrored with respect to one of its neighbors, etc.).

The foregoing is merely illustrative and various modifications can be made to the described embodiments. The foregoing embodiments may be implemented individually or in any combination.

What is claimed is:

1. A display, comprising:

a first data line;

a first display pixel having:

a first drive transistor having a gate terminal, a drain terminal, and a source terminal;

a first organic light-emitting diode coupled in series with the first drive transistor;

a semiconducting-oxide transistor coupled between the gate and drain terminals of the first drive transistor; and a data loading transistor coupled between the source terminal of the first drive transistor and the first data line;

a second display pixel having a second organic-light emitting diode coupled in series with a second drive transistor; and a second data line coupled to the second display pixel, wherein the first and second drive transistors are physically interposed between the first and second data lines to reduce column pixel crosstalk.

2. The display of claim 1, wherein the first display pixel is mirrored with respect to the second display pixel.

3. The display of claim 1, wherein first drive transistor has a drain terminal coupled to a routing line, and wherein routing line and the first data line are formed in the same metal routing layer of the display so that no shielding layer can be formed between the first drive transistor and the first data line.

4. The display of claim 1, wherein first drive transistor has a drain terminal coupled to a routing line, and wherein routing line and the first data line are formed in adjacent metal routing layers in the display so that no shielding layer can be formed between the first drive transistor and the first data line.

5. The display of claim 1, further comprising:

a third display pixel coupled to the first data line, wherein the third display pixel has the same orientation as the first display pixel.

6. The display of claim 5, further comprising:

a fourth display pixel coupled to the second data line, wherein the fourth display pixel has the same orientation as the second display pixel.

7. The display of claim 1, wherein the first display pixel is part of a first pixel column, and wherein every display pixel in the first pixel column has the same orientation.

8. The display of claim 7, wherein the second display pixel is part of a second pixel column, and wherein every display pixel in the second pixel column has the same orientation.

9. The display of claim 8, wherein the first and second pixel columns are adjacent pixel columns in the display.

10. The display of claim 1, wherein the semiconducting-oxide transistor is configured to receive a first scan line signal, and wherein the data loading transistor is configured to receive a second scan line signal that is different than the first scan line signal.

11. The display of claim 10, wherein the first scan line signal is pulsed, and wherein the second scan line signal is pulsed only while the first scan line signal is pulsed.

12. The display of claim 11, wherein the second scan line signal has a rising pulse edge, and wherein the first scan line signal has a falling pulse edge following the rising pulse edge of the second scan line signal.

13. The display of claim 12, wherein the gate, drain, and source terminals of the first drive transistor are electrically floating during the time period between rising pulse edge of the second scan line signal and the falling pulse edge of the first scan line signal.

14. A display, comprising:

a first pixel column configured to support in-pixel threshold voltage compensation, wherein data is loaded into the first pixel column during a threshold voltage sampling and data programming phase, and wherein at least one pixel in the first pixel column comprises a drive transistor that is electrically floating for a predetermined period of time after the threshold voltage sampling and data programming phase; and a second pixel column configured to support in-pixel threshold voltage compensation, wherein the second pixel column is mirrored with respect to the first pixel column to prevent the drive transistor in the first pixel column from being perturbed by data signals toggling in the second pixel column during the predetermined period of time.

15. The display of claim 14, wherein each pixel in the first pixel column exhibits the same orientation.

16. The display of claim 15, wherein each pixel in the second pixel column exhibits the same orientation.

17. The display of claim 14, wherein the first pixel column is coupled to a first data line, wherein the second pixel column is coupled to a second data line, and wherein the first and second pixel columns are surrounded by the first and second data lines.

18. The display of claim 14, wherein there is no data line physically interposed between the first and second pixel columns.

19. Display circuitry, comprising:

a first pixel having a first side and a second side opposing the first side, wherein the first pixel is coupled to a first data line formed on the first side of the first pixel; and a second pixel having a first side and a second side opposing the first side, wherein:

the second side of the second pixel directly faces the second side of the first pixel;

the second pixel is coupled to a second data line formed on the first side of the second pixel;

the first pixel has an organic light-emitting diode coupled to a drive transistor; and the parasitic coupling capacitance between the drive transistor and the first data line is less than the parasitic coupling capacitance between the drive transistor and the second data line.

20. The display circuitry of claim 19, wherein the second data line is not physically interposed between the first and second pixels.

* * * * *